US006357431B1

(12) United States Patent
DeGroot et al.

(10) Patent No.: US 6,357,431 B1
(45) Date of Patent: Mar. 19, 2002

(54) WAVE FORM FUEL/AIR SENSOR TARGET VOLTAGE

(75) Inventors: Kenneth P DeGroot, Macomb Township; Yi Cheng, Jackson; Edward M Vuylsteke, Ann Arbor; Timothy A Coatesworth, Lake Orion; Jonathan F Rose, Westland; Bruce H Teague, Grosse Pointe Park; Michael J Reale, Royal Oak, all of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/574,537

(22) Filed: May 18, 2000

(51) Int. Cl.[7] ..... F02D 41/00
(52) U.S. Cl. ..... 123/694; 123/696
(58) Field of Search ..... 123/694, 696, 123/672, 693

(56) References Cited

U.S. PATENT DOCUMENTS 5,465,697 A * 11/1995 Hamburg et al. ..... 123/694
5,467,593 A 11/1995 Vincent et al.
5,778,866 A * 7/1998 Uchikawa ..... 123/696
6,085,734 A * 7/2000 DeGroot et al. ..... 123/696
6,260,547 B1 * 7/2001 Spencer-Smith ..... 123/694

* cited by examiner

*Primary Examiner*—John Kwon
(74) *Attorney, Agent, or Firm*—Mark P. Calcaterra

(57) ABSTRACT

A method of determining a goal voltage for a fuel/air sensor of an engine electronic fuel injection system includes the steps of determining a goal fuel/air sensor voltage, superimposing a wave form forcing function to the fuel/air sensor voltage for providing a goal fuel/air sensor voltage having a wave form pattern and controlling the engine to operate according to the goal fuel/air sensor voltage. The wave form forcing function provides the required fuel/air perturbations that are required to retain proper oxygen storage of the catalyst to maintain high three-way conversion efficiency.

12 Claims, 2 Drawing Sheets

WAVE FORM FUEL/AIR SENSOR TARGET VOLTAGE

FIELD OF THE INVENTION

The present invention relates generally to electronic fuel injection systems for internal combustion engines in automotive vehicles and, more particularly, to a method of feedback control for an electronic fuel injection system in an internal combustion engine for an automotive vehicle.

BACKGROUND

Modern automotive vehicles have an exhaust system which includes a three-way catalyst to simultaneously reduce HC, CO and $NO_x$ emissions from an internal combustion engine in the vehicle if the fuel/air ratio of the feed gas to the engine is maintained within a narrow window. To accomplish this, automotive vehicles have used an $O_2$ sensor located upstream of the catalyst for fuel/air feedback control.

With the current $\mathbf{0}_2$ sensor for feedback control, a voltage output signal of the $O_2$ sensor is compared to a calibratible voltage threshold to determine if the fuel/air ratio is rich or lean. When the voltage output signal is determined to switch from lean to rich (for example, to go from below to above the $O_2$ sensor switch point calibration), an $O_2$ controller kicks lean and begins to ramp lean until the $O_2$ sensor voltage output signal changes from rich to lean. Then, the $O_2$ controller kicks rich and begins to ramp rich until the $O_2$ sensor voltage output signal changes again from lean to rich.

While the use of the current $O_2$ sensor has worked well, the $O_2$ sensor is subject to both short and long term errors that affect fuel/air control. The short term errors are due to shifts in the $O_2$ sensor voltage output signal based on exhaust gas temperature and composition. The long term errors are due to aging of the sensor as a result of sustained high exhaust gas temperatures and to potentially poisonous exhaust emissions. These factors can lead to a slowed $O_2$ sensor response and a shift in the voltage of the output signal relative to the fuel/air ratio with time.

SUMMARY OF THE INVENTION

It is, therefore, one object of the present invention to provide an upstream fuel/air sensor and a downstream $O_2$ sensor for fuel/air feedback control to improve catalyst efficiency and reduce exhaust emissions.

It is another object of the present invention to provide a method of electronic fuel injection feedback control based on the use of a fuel/air sensor upstream of the catalyst and an $O_2$ sensor downstream of the catalyst. (Although the primary object of the present invention is exploiting the use of an upstream fuel/air sensor, the scope of the invention can also include other sensors such as a typical upstream oxygen sensor.)

To achieve the foregoing objects, the present invention provides a method of determining a goal voltage for a fuel/air sensor of an engine control system comprising the steps of determining an optimal fuel/air ratio for the current vehicle operating conditions; determining a fuel/air sensor target voltage corresponding with said optimal fuel/air ratio; applying a wave form forcing function to said fuel/air sensor voltage for providing a goal fuel/air sensor voltage having a wave form pattern; and controlling said engine to operate according to said goal fuel/air sensor voltage.

In order to obtain a high level of catalyst efficiency through the fuel/air control via a fuel/air sensor, a wave form pattern goal voltage is utilized according to the present invention. Catalysts require fuel/air perturbations to retain proper oxygen storage to maintain high efficiency. Fuel/air sensor output signals are relatively flat as opposed to the characteristics of an oxygen sensor signal, which is normally vertical at stoichiometric. Thus, a swing through the stoichiometric fuel/air mixture level becomes more difficult with a fuel/air sensor when locking on to a goal voltage. The use of a wave form pattern goal voltage insures that there are periodic fuel/air perturbations to apply a forcing function to cause the fuel/air ratio to go from rich to lean periodically.

The wave form forcing function can be a sine wave, a square wave, or V wave, or other wave forms.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
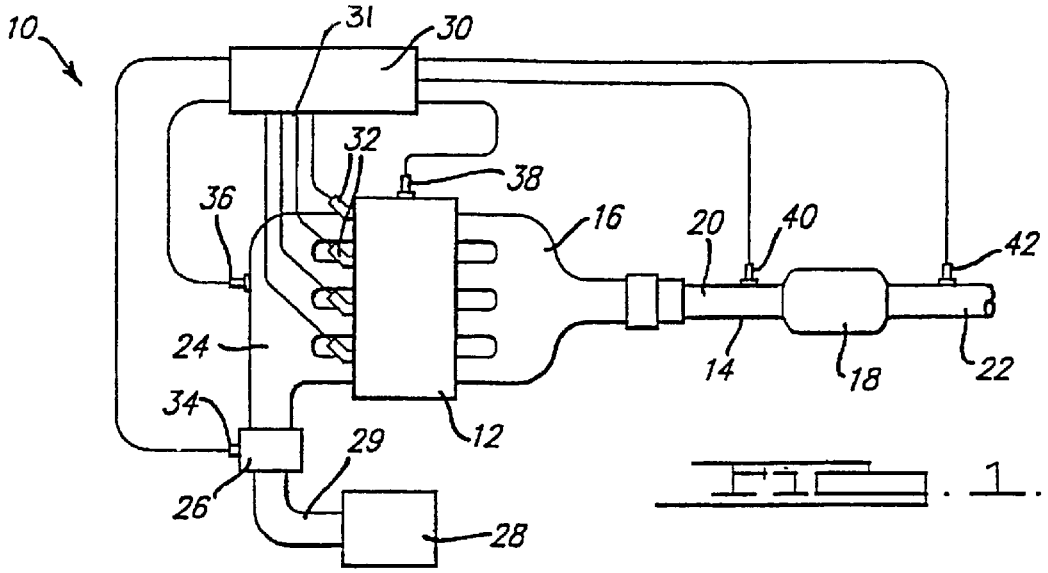
FIG. 1 is schematic diagram of an electronic fuel injection system, according to the present invention, illustrated in operational relationship with an internal combustion engine and exhaust system of an automotive vehicle.

Referring to FIG. 1, an electronic fuel injection system 10, according to the present invention, is illustrated in operational relationship with an internal combustion engine 12 in an exhaust system 14 of an automotive vehicle (not shown). The exhaust system 14 includes an exhaust manifold 16 connected to the engine 12 and a catalyst 18 such as a catalytic converter connected by an upstream conduit 20 to the exhaust manifold 16. The exhaust system 14 also includes a downstream conduit 22 connected to the catalyst 18 and extending downstream to a muffler (not shown). The engine 12 includes an intake manifold 24 connected thereto and a throttle body 26 connected to the intake manifold 24. The engine 12 includes an air filter 28 connected by a conduit 29 to the throttle body 26. It should be appreciated that the engine 12 and exhaust system 14 are conventional and known in the art.

The electronic fuel injection system 10 includes an engine controller 30 having fuel injector outputs 31 connected to corresponding fuel injectors 32 of the engine 12 which meter an amount of fuel to the cylinders (not shown) of the engine 12. The electronic fuel injection system 10 also includes a throttle position sensor 34 connected to the throttle body 26 and the engine controller 30 to sense an angular position of the throttle plate (not shown) in the throttle body 26. The electronic fuel injection system includes a manifold absolute pressure (MAP) sensor and/or mass airflow sensor (MAF) 36 connected to the intake manifold 24 and the engine controller 30 to sense MAP and/or MAF. The electronic fuel injection system 10 also includes a coolant temperature sensor 38 connected to the engine 12 and the engine controller 30 to sense a temperature of the engine 12. The electronic fuel injection system 10 further includes an upstream fuel/air sensor 40 connected to the upstream conduit 20 of the exhaust system 14 and a downstream $O_2$ sensor 42 connected to the downstream conduit 22 of the exhaust system 14. The front fuel/air sensor 40 and the rear $O_2$ sensor 42 are connected to the engine controller 30 to sense the uncatalized fuel/air and the fully catalized $O_2$ levels, respectively, in the exhaust gas from the engine 12.

It should be appreciated that the engine controller 30 and sensors 34, 36, 38 and 42 are conventional and known in the art. Less known is the fuel/air sensor 40 which is a wide range fuel/air sensor. This sensor enables measurement of all ranges of the fuel/air mixture, but it can also detect the stoichiometric point precisely. The output of a wide range fuel/air sensor is an oxygen pumping current that is proportional to the amount of oxygen in the exhaust gas on the lean side (range) and the amount of oxygen required for complete combustion in the exhaust gas on the rich side (range). At stoichiometric, when the oxygen partial pressure of the exhaust gas and that in the detecting cavity is the same, oxygen pumping is not accomplished and the pumping current is always equal to zero.

The fuel/air sensor 40 is described in SAE paper number 920234, which is herein incorporated by reference.

Figure 2:
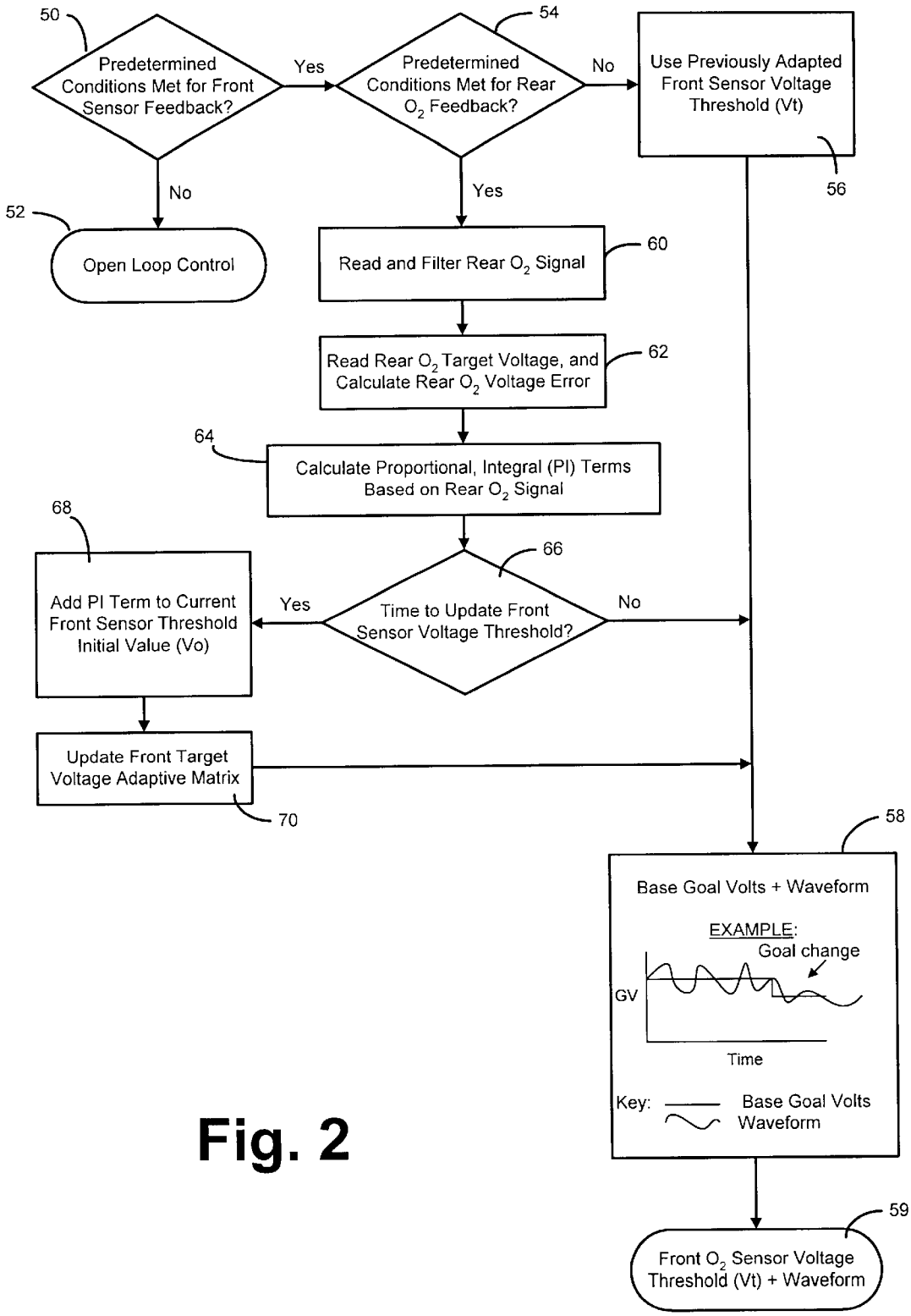
FIG. 2 is a flowchart of a method of feedback control, according to the present invention, for the electronic fuel injection system of FIG. 1.

Referring to FIG. 2, a method of feedback control, according to the present invention, is illustrated for the electronic fuel injection system 10. The methodology begins in diamond 50 and determines whether predetermined conditions have been met for feedback from the front fuel/air sensor 40, such as whether the throttle angle and MAP are within predetermined ranges as sensed by the sensors 34 and 36, respectively. If not, the methodology advances to bubble 52 and performs open loop control of the fuel injection system 10. Alternatively, if the front fuel/air sensor conditions have been met, the methodology advances to diamond 54 and determines whether predetermined conditions have been met for feedback from the rear $O_2$ sensor 42, such as whether the throttle angle and MAP are within predetermined ranges. If not, the methodology advances to block 56 and uses a previously adapted front fuel/air sensor switching voltage threshold (Vt) which is an initial value Vo based on either a previous front sensor switching voltage threshold or a RAM location from a front sensor switching target voltage adaptive matrix stored in memory of the engine controller 30. The methodology then advances to block 58 and adds a wave form forcing function to the switch voltage threshold (Vt). The wave form pattern goal voltage is utilized in order to obtain a high level of catalyst efficiency. Catalysts require fuel/air perturbations to retain proper oxygen storage to maintain high efficiency. The wave form can be a sine wave, square wave, V-wave, or other wave form. Bubble 59 then uses the front sensor switching voltage threshold (Vt) with the superimposed wave form for controlling the electronic fuel injection system 10 to be described.

In diamond 54, if the predetermined conditions have been met for feedback from the rear $O_2$ sensor 42, the methodology advances to block 60. In block 60, the methodology reads and filters the voltage output signal from the rear $O_2$ sensor 42. The methodology then advances to block 62 and reads a rear $O_2$ target voltage and calculates a rear $O_2$ voltage error. The engine controller 30 reads the rear $O_2$ target voltage based on the engine operating conditions and is obtained from a matrix of RPM and MAP. The engine controller 30 calculates the rear $O_2$ voltage error by subtracting the actual voltage of the output signal from the rear $O_2$ sensor 42 of block 60 from the rear $O_2$ target voltage. The rear $O_2$ voltage error (target voltage-actual voltage) is passed through a linear PI (proportional integral) control routine to produce the front sensor switching voltage threshold (Vt) changes. The methodology advances to block 64 and calculates the proportional and integral PI terms based on the rear $O_2$ signal as follows:

$$\text{PI term}=Kp*Ve+\Sigma(Ki*Ve)dt$$

The proportional term for the PI term is (Kp*Ve) where Kp is a calibration constant for the proportional term and Ve is the rear $O_2$ voltage error calculated in Block 62. The integral term for the PI term is essentially the summation of the voltage error over time; example <Σ(Ki*Ve) dt> or <Ki*ΣVe dt> where Ki is a calibration constant for the integral term which may vary with operating conditions and dt is the time factor. It should be appreciated that the PI term is a proportional gain element multiplied by the rear $O_2$ sensor voltage error, plus an integral gain element multiplied by voltage error.

From block 64, the methodology advances to diamond 66 and determines whether it is time to update the front sensor switching voltage threshold (Vt). If not, the methodology advances to block 58 and then bubble 59 previously described. Alternatively, if it is time to update the front sensor switching threshold (Vt), the methodology advances to block 68 and adds the PI term calculated in block 64 to the current front sensor switching voltage threshold initial value ($V_o$) as follows:

$$Vt=Vo+\text{PI Term}$$

The methodology then advances to block 70 and updates the front sensor switching target voltage adaptive matrix for Vo with the newly calculated Vt term. The methodology then advances to block 58 and bubble 59 previously described.

After bubble 59, the methodology compares a voltage output from the front sensor 40 to the front sensor switching voltage threshold (Vt) with the added wave form to determine if the fuel/air ratio of the engine is rich or lean. The methodology then decreases or increases the amount of fuel to the engine 12 by the fuel injectors in response to signals from the engine controller 30 via the fuel injector outputs 32.

Accordingly, the rear $O_2$ sensor 42 is used to modify the front sensor switching voltage threshold or switch point (instead of using a fixed value for the front sensor over the life of the vehicle). The rear $O_2$ sensor output voltage is monitored, filtered, and compared to a target voltage to calculate a rear $O_2$ voltage error. The rear $O_2$ voltage error is integrated over time and adjustments are made to the front sensor switch point to drive the error in the rear $O_2$ sensor voltage to zero.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of controlling a fuel/air mixture for a vehicle having an internal combustion engine, comprising the steps of:

determining an optimal fuel/air ratio for the current vehicle operating conditions;

determining a fuel/air sensor voltage corresponding with said optimal fuel/air ratio;

adding a wave form forcing function to said fuel/air sensor voltage for providing a goal fuel/air sensor voltage having a wave form pattern; and controlling said engine to operate according to said goal fuel/air sensor voltage.

2. The method according to claim 1, wherein said wave form pattern of said goal fuel/air sensor voltage passes back and forth through a stoichiometric fuel/air mixture ratio point.

3. The method according to claim 1, wherein said wave form forcing function is a sine wave.

4. The method according to claim 1, wherein said wave form forcing function is a square wave.

5. The method according to claim 1, wherein said wave form forcing function is a V-shaped wave.

6. The method according to claim 1, wherein said wave form forcing function is any other appropriate wave form.

7. An internal combustion engine, comprising:

an engine block defining at least one cylinder;

a piston disposed in said at least one cylinder;

a crankshaft connected to said piston;

an inlet port in communication with said at least one cylinder;

an outlet port in communication with said at least one cylinder;

an exhaust passage in communication with said outlet port;

a catalyst disposed in said exhaust passage;

a fuel/air sensor disposed in said exhaust passage;

a fuel/air delivery system for providing a fuel/air mixture to said inlet port; and;

a control system for controlling said fuel/air delivery system, said control system determining a goal voltage for said fuel/air sensor, said goal voltage being added to a wave form forcing function which causes said fuel/air mixture to pass back and forth through stoichiometric, said control system receiving signals from said fuel/air sensor and controlling said fuel/air delivery system based upon said goal voltage and said signals from said fuel/air sensor.

8. The system according to claim 7, wherein said wave form forcing function is a sine wave.

9. The system according to claim 7, wherein said wave form forcing function is a square wave.

10. The system according to claim 7, wherein said wave form forcing function is a V-shaped wave.

11. The system according to claim 7, wherein said wave form forcing function is any other appropriate wave form.

12. A method of controlling a fuel/air mixture for a vehicle having an internal combustion engine having an open loop downstream fuel control system comprising the steps of:

determining an optimal fuel/air ratio for the current vehicle operating conditions;

using a wave form forcing function in the downstream fuel control system.

* * * * *